US006638162B2

(12) United States Patent
Bennett

(10) Patent No.: US 6,638,162 B2
(45) Date of Patent: Oct. 28, 2003

(54) CARD GAME

(75) Inventor: Nicholas Luke Bennett, Sydney (AU)

(73) Assignee: Aristocrat Technologies Australia Pty Ltd., Lane Cove (AU)

( * ) Notice: Subject to any disclaimer, the term of this patent is extended or adjusted under 35 U.S.C. 154(b) by 97 days.

(21) Appl. No.: 09/848,188

(22) Filed: May 2, 2001

(65) Prior Publication Data

US 2002/0037761 A1 Mar. 28, 2002

(30) Foreign Application Priority Data

May 3, 2000 (AU) ..... PQ7265

(51) Int. Cl.[7] ..... A63F 9/24

(52) U.S. Cl. ..... 463/13

(58) Field of Search ..... 463/11, 12, 13; 273/292, 293

(56) References Cited

U.S. PATENT DOCUMENTS

| | | | | |
|---|---|---|---|---|
| 5,332,228 A | * | 7/1994 | Schultz | 273/292 |
| 6,042,118 A | * | 3/2000 | Poitra | 273/292 |
| 6,170,823 B1 | * | 1/2001 | Kintner | 273/236 |
| 6,176,781 B1 | * | 1/2001 | Walker et al. | 463/13 |
| 6,358,144 B1 | * | 3/2002 | Kadlic et al. | 463/13 |

* cited by examiner

*Primary Examiner*—Terry M. Argenbright
(74) *Attorney, Agent, or Firm*—Katten Muchin Zavis Rosenman

(57) ABSTRACT

A gaming machine 10 has a display 14 and a game controller 34 arranged to control images displayed on the display. The game controller 34 is arranged to play a game of poker 20 wherein a hand of cards 18 is randomly selected from at least one deck of cards and displayed on the display 14. If a winning hand results, the machine 10 pays a prize. The deck of cards 18 includes at least one multi-function card 50, 100, 110 which substitutes for at least two, but less than all, standard cards of the deck.

8 Claims, 5 Drawing Sheets

CARD GAME

FIELD OF THE INVENTION

This invention relates to a gaming machine. More particularly, the invention relates to a gaming machine of the type arranged to play a game of poker and, more specifically, the invention relates to an improvement to a game played on such a machine.

BACKGROUND TO THE INVENTION

Players who regularly play gaming machines quickly tire of particular games and therefore it is necessary for manufacturers of these machines to come up with innovative game features that add interest to the games provided on such machines in order to keep the players amused and therefore willing to continue playing the games.

Gaming machines are continuing to gain in popularity both in Australia and worldwide. Substantial amounts of money are wagered on these machines. With the growth that has occurred in the gaming machine market, there is intense competition between manufacturers to supply various existing and new venues. When selecting a supplier of gaming machines, the operator of such a venue will pay close attention to the popularity of various games with their patrons.

Therefore, gaming machine manufacturers are keen to devise games which are popular with players as a mechanism for improving sales, retaining existing customers and attracting new customers.

SUMMARY OF THE INVENTION

According to a first aspect of the invention, there is provided a gaming machine having a display means and a game control means arranged to control images displayed on the display means, the game control means being arranged to play a game of poker wherein a hand of cards is randomly selected from at least one deck of cards and displayed on the display means and, if a winning hand results, the machine pays a prize, the game being characterised in that the deck of cards includes at least one multi-function card which substitutes for at least two, but less than all, standard cards of the deck.

In a preferred embodiment, the deck of cards may include a plurality of said multi-function cards. Each multi-function card may carry, in addition to its face value and suit representation, at least one additional function performing symbol. The additional function performing symbol may be represented in any suitable format including a different colour of card.

In one embodiment of the invention, each multi-function card may act as a substitute card. The additional symbol may relate to at least one additional suit and, possibly, all three remaining suits. The number of suits appearing on each multi-function card may be governed by a wager made by a player. Thus, if a player stakes one credit only a single suit may appear on each card. If a player stakes two credits, two suits may appear on each card etc.

In another embodiment of the invention, the multi-function cards may constitute a separate suit so that, for example, prizes could be awarded for a natural flush in multi-function cards. Preferably, the deck of cards includes a further suit of the multi-function cards. Thus, the deck of cards may comprise the 52 standard cards, one or more jokers and a suit of thirteen multi-function cards.

In yet another embodiment of the invention, the additional function performing symbol may be a multi-value symbol so that, when it appears on a card, the card represents, not only its own face value, but also at least one other, predetermined face value. For example, a picture card could represent all the picture or 'royal' cards. Instead, a '+' or '−' symbol could be carried on said multi-function card. If a '+' symbol is present, the card may represent its own face value plus all those above it. Conversely, if a '−' symbol is present, the card may represent its own face value plus all those below it. Still further, said multi-function card could represent, in addition to its face value, at least one further face value. Thus, for example, a "5/K" card would represent either a Five or a King. The cards of this embodiment could also be multi-suit cards or they may represent only one suit.

According to a second aspect of the invention, there is provided a gaming machine having a display means and a game control means arranged to control images displayed on the display means, the game control means being arranged to play a game of poker wherein a hand of cards is randomly selected from at least one deck of cards and displayed on the display means and, if a winning hand results, the machine pays a prize, the game being characterised in that the deck of cards includes at least one suit of cards which substitutes for at least one other suit of cards of the deck.

BRIEF DESCRIPTION OF THE DRAWINGS

The invention is now described by way of example with reference to the accompanying drawings in which.

DETAILED DESCRIPTION OF THE DRAWINGS

Figure 1:
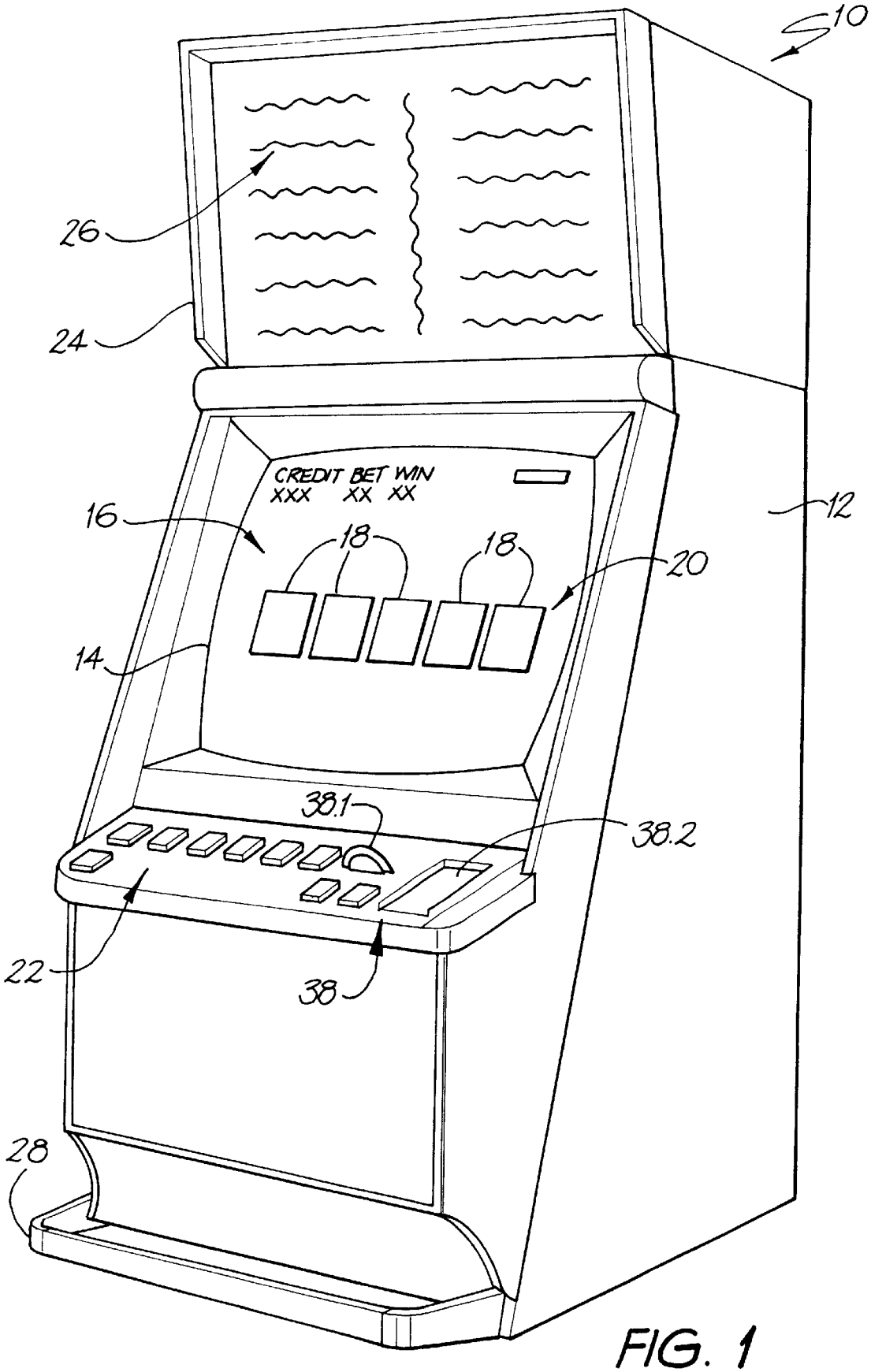
FIG. 1 shows a three dimensional view of a gaming machine, in accordance with the invention.

In FIG. 1, reference numeral 10 generally designates a gaming machine, including a game, in accordance with the invention. The machine 10 includes a console 12 having a video display unit 14 on which a game 16 is displayed, in use. The game 16 is a card game, more particularly, a poker game. The game 16 simulates the dealing of a number of cards 18 into a poker hand 20. An actuating means in the form of a bank 22 of buttons facilitates playing of the game 16.

The machine 10 includes a top box 24 on which artwork 26 is carried. The artwork 26 includes paytables, details of bonus awards, etc. A coin tray 28 is mounted beneath the console 12 for cash payouts from the machine 10.

Figure 2:
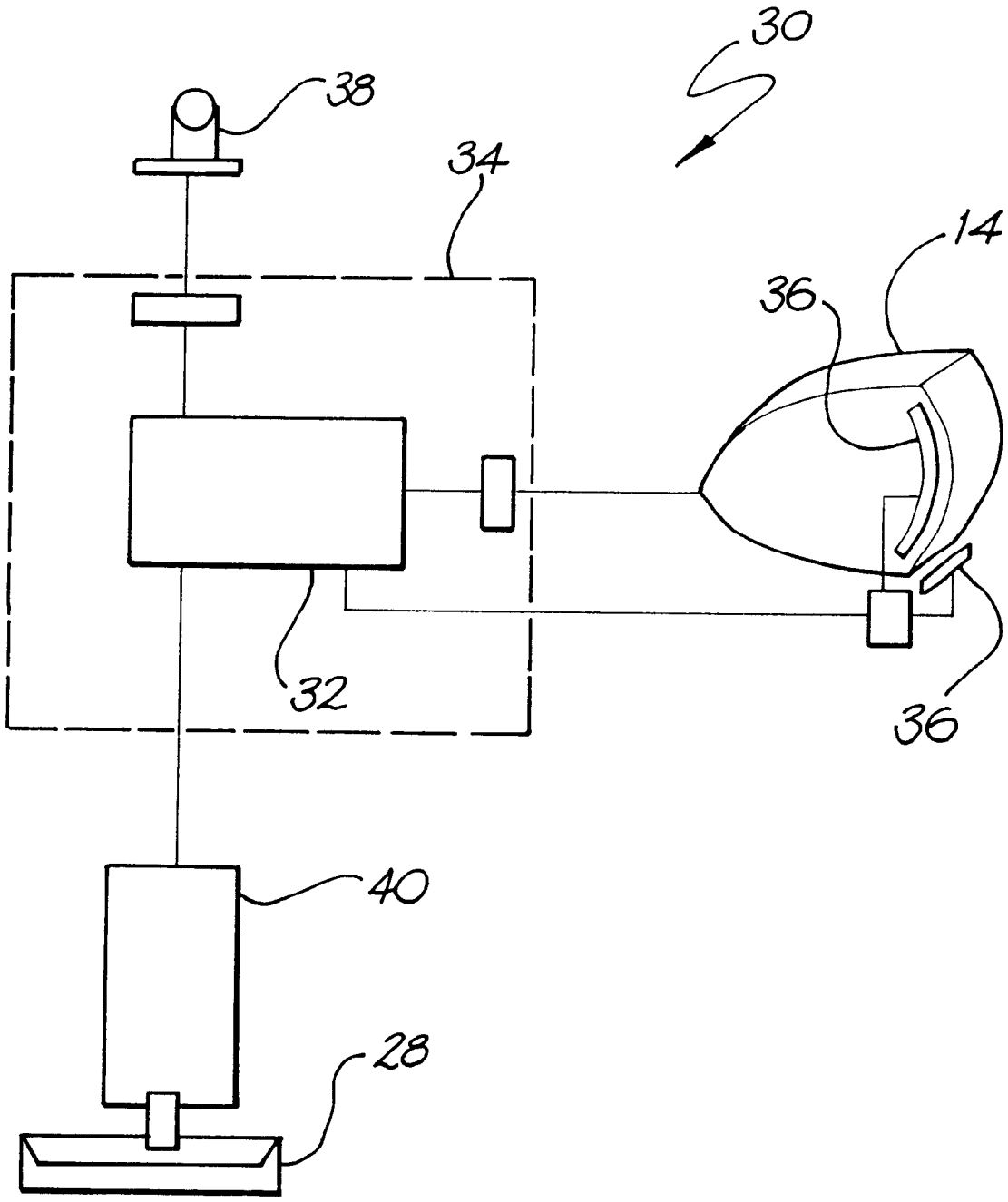
FIG. 2 shows a schematic block diagram of a control circuit of the gaming machine of FIG. 1.

Referring now to FIG. 2 of the drawings, a control means or control circuit 30 is illustrated. A program which implements the game and user interface is run on a processor 32 of the control circuit 30. The processor 32 forms part of a controller 34 which drives the screen of the video display unit 14 and which receives input signals from sensors 36. The sensors 36 are associated with the bank 22 of buttons and also touch sensors mounted in the screen of the video display unit 14.

The controller 34 receives input pulses from a mechanism 38 indicating that a player has provided sufficient credit to commence playing. The mechanism 38 includes a coin input chute 38.1 and a bill collector 38.2. The mechanism may also include a credit card reader (not shown), or any other type of validation device.

Finally, the controller 36 drives a payout mechanism 40 which, for example, may be a coin hopper for feeding coins to the coin tray 28 to make a pay out to a player when the player wishes to redeem his or her credit.

As indicated above, the game 16 is a simulated card game and, more particularly, a poker game.

Figure 3:
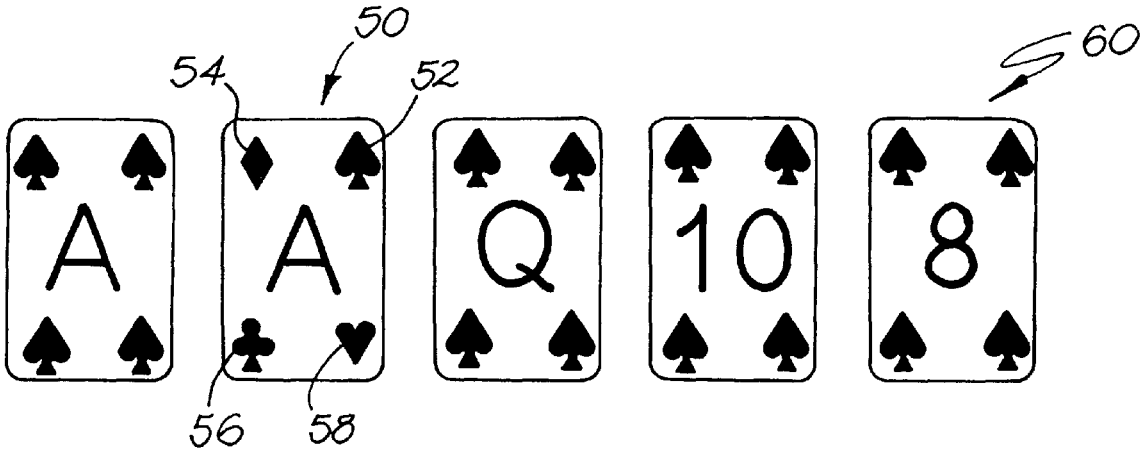
FIG. 3 shows a schematic screen display of a first example of a result of a game played on the gaming machine of FIG. 1.

The deck of cards used in the playing of the game 16 on the machine 10 includes the standard 52 cards comprising suits of spades, diamonds, clubs and hearts. In addition, the deck of cards, which may also include one or more jokers (not shown), includes a set of multi-function cards. In the embodiments illustrated in FIGS. 3 to 6 of the drawings, a full set of thirteen multi-function cards is assumed to be included in the deck but it will be appreciated that a full suit of multi-function cards may not be included. Further, it is assumed that the multi-function cards carry symbols on them illustrating all four suits. Hence, as shown in FIG. 3 of the drawings where a multi-function Ace card 50 is shown, the card includes a spade symbol 52, a diamond symbol 54, a club symbol 56 and a heart symbol 58.

The presence of the multi-function cards 50 having multiple suits results in variations of standard poker hands being possible with resultant additional winning combinations which are defined. Assuming that the deck includes one or more jokers, the following combinations could apply:

| Name of combination | Description |
|---|---|
| Royal Flush (Natural) | A, K, Q, J and 10 that are:<br>all clubs, or<br>all spades, or<br>all hearts, or<br>all diamonds, or<br>all multi-suits. |
| Royal Flush (Non-natural) | The Royal Flush (Natural) combination in clubs, spades, hearts or diamonds where at least one of the cards has been substituted by a multi-suit or a joker, or<br>The Royal Flush (Natural) combination in multi-suit where at least one of the cards has been substituted by a joker. |
| Royal Straight (Natural) | A, K, Q, J and 10 that are any combination of suits with at least two of hearts, diamonds, clubs and/or spades. |
| Royal Straight (Non-natural) | The Royal Straight (Natural) combination where at least one of the cards has been substituted by a joker. |
| 5 of a kind (Natural) | The heart, diamond, club, spade and multi-suit card all of one value. |
| 5 of a kind (Non-natural) | The 5 of a kind (Natural) combination where at least one of the cards in the combination has been substituted by a joker. |
| Straight Flush (Natural) | 5 cards with values in consecutive order that are:<br>all clubs, or<br>all spades, or<br>all hearts, or<br>all diamonds, or<br>all multi-suits. |
| Straight Flush (Non-natural) | The Straight Flush (Natural) combination in clubs, spades, hearts or diamonds where at least one of the cards has been substituted by either a joker or a multi-suit card, or<br>The Straight Flush (Natural) combination in multi-suit where at least one of the cards has been substituted by a joker. |
| 4 of a kind (Natural) | 4 cards of one value and one card of another value.<br>No joker may be present in the hand. |
| 4 of a kind (Non-natural) | The 4 of a kind (Natural) combination where at least one of the 4 cards of the same value has been substituted by a joker. |
| Flush (Natural) | The 5 cards are:<br>all clubs, or<br>all spades, or<br>all hearts, or<br>all diamonds, or<br>all multi-suits. |
| Flush (Non-natural) | The Flush (Natural) combination in clubs, spades hearts or diamonds where at least one of the cards has been substituted by either a joker or a multi suit card, or<br>The Flush (Natural) combination in multi-suit where at least one of the cards has been substituted by a joker. |
| Straight (Natural) | 5 cards with values in consecutive order that can be of any suit or multi-suit. (Note: Ace can be treated as the highest or lowest value card) |
| Straight (Non-natural) | The Straight (Natural) combination where at least one of the cards has been substituted by a joker. |
| Full House (Natural) | 3 cards of one value and 2 of another value that can be of any suit or multi-suit. |
| Full House (Non-natural) | The Full House (Natural) combination where at least one of the cards has been substituted by a joker. |
| 3 of a kind (Natural) | 3 cards of one value, 1 card of another value, and 1 card of yet another value.<br>No joker may be present in the hand. |
| 3 of a kind (Non-natural) | The 3 of a kind (Natural) combination where at least one of the 3 cards of the same value has been substituted by a joker. |
| Two Pair (Natural) | 2 cards of one value, 2 cards of another value and 1 card of yet another value.<br>No joker may be present in the hand. |
| Two Pair (Non-natural) | The Two Pair (Natural) combination where at least one of the cards from either of the pairs of same value cards has been substituted by a joker. (Note that this will always result in at least a 3 of a kind combination and hence will not usually be a possible paying combination). |

It is to be understood that, in the table as set out above, the 'value' of cards in a standard deck is: ace=1 or 14, jack=11, queen=12 and king=13 with the other cards having their face values.

The definition of whether a multi-suit card 50 is considered to be "natural" may change depending on the combination in which it is being considered. In other words, for certain combinations, the multi-suit card 50 is considered to belong to a suit of its own, for example, for a natural flush in multi-suit cards 50. For other combinations, the multi-suit card 50 is considered as a substitute for one of the other suits. This results in a dual function for the multi-suit cards 50.

Also, it is to be noted that, in respect of the table above, generally only the highest win will be paid. Thus, when specific combinations fall into more than one of the categories shown in the table, only the highest winning combination is paid. In addition, if the hand dealt includes one or more jokers, a bonus may be paid.

Examples of hands including the multi-function card 50 are now described with reference to FIGS. 3 to 6 of the drawings. In FIG. 3, a hand 60 is dealt including the multi-function Ace card 50. The other four cards of the hand 60, all being cards of the spades suit, means that the hand 60 is a non-natural flush in spades because the multi-suit Ace card 50 is treated as substituting for a spade card.

Figure 4:
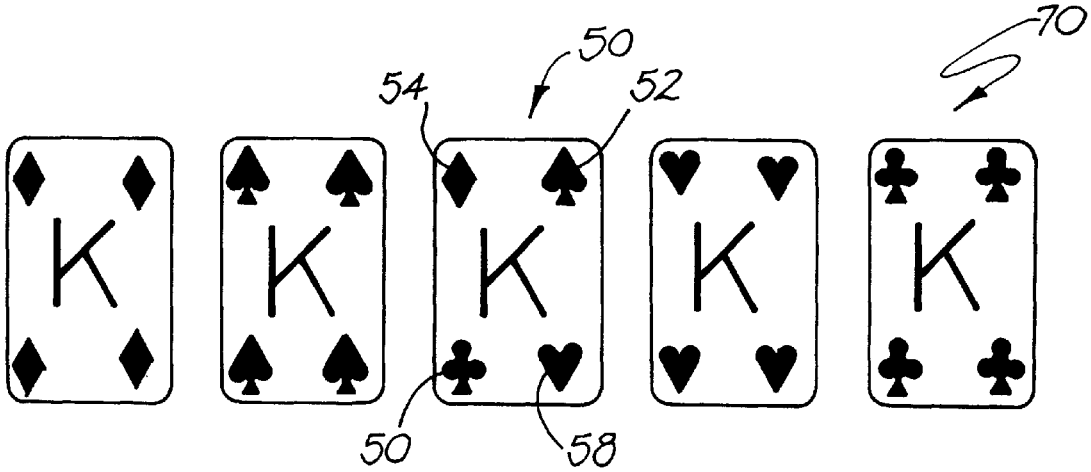
FIG. 4 shows a schematic screen display of a second example of a result of a game played on the gaming machine of FIG. 1.

Referring to FIG. 4 of the drawings, a hand 70 is illustrated, including a multi-function King card 50. This hand 70 is a natural five of a kind combination because the suit of the multi-function card 50 is not relevant to the hand but the value of the multi-function King card 50 matches that of the other cards in the hand 70.

Figure 5:
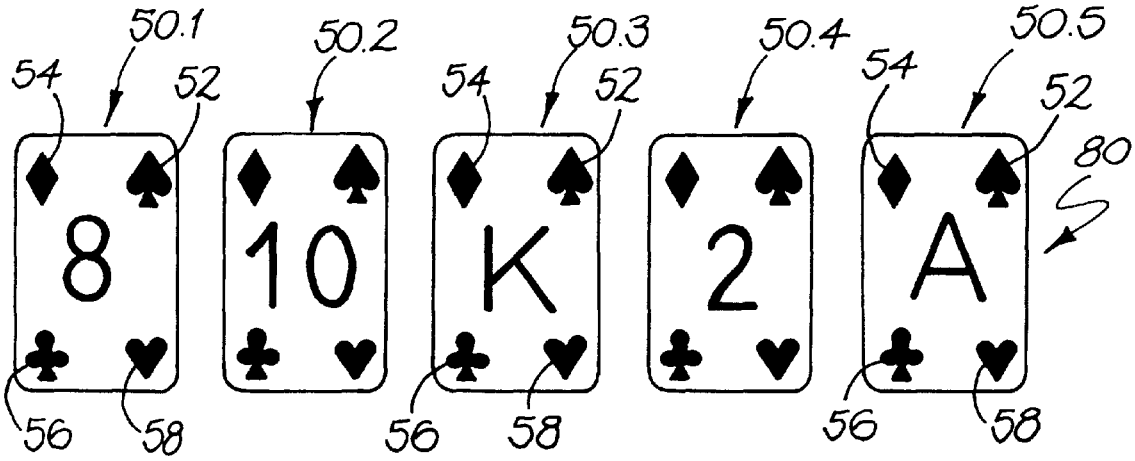
FIG. 5 shows a schematic screen display of a third example of a result of a game played on the gaming machine of FIG. 1.

In FIG. 5 of the drawings, a hand 80 is illustrated where five multi-function cards 50.1–50.5 are dealt. Even though the suit is relevant to a flush combination, the hand 80 will still pay as a natural flush because all the cards are multi-suit cards 50. Accordingly, the hand 80 is treated as being a flush in multi-suit cards rather than the multi-suit cards substituting for one of the other four suits.

Figure 6:
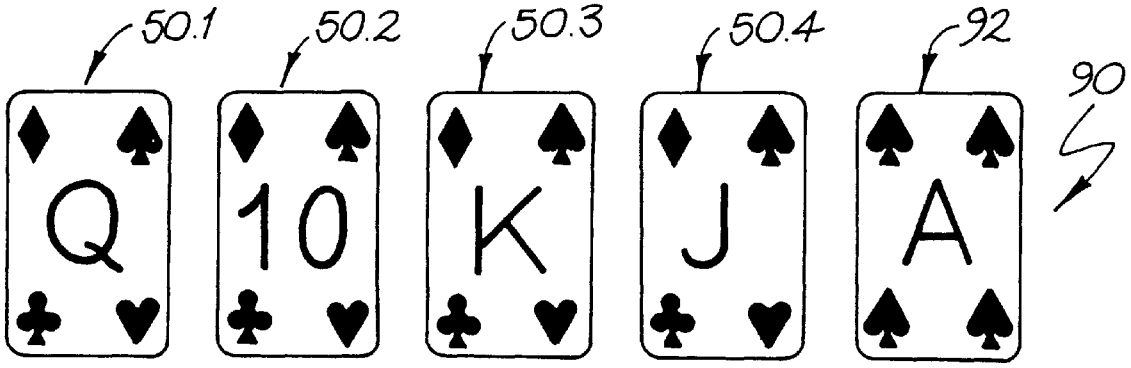
FIG. 6 shows a schematic screen display of a fourth example of a result of a game played on the gaming machine of FIG. 1.

This is to be contrasted with the hand 90 shown in FIG. 6 of the drawings. In this hand, four multi-suit cards 50.1–50.4 are dealt together with an Ace of spades card 92. This hand 90 pays as a non-natural royal flush because the presence of the spade card 92 means that the multi-suit cards 50.1–50.4 are in fact substituting as spades rather than being treated as multi-suit cards in their own right.

In other embodiments of the invention, the multi-suit cards 50 need not be treated as a separate suit and would only then be used to substitute for one of the other four suits. In this embodiment also or in the embodiment as described above, a deck of cards could be created where some of the multi-suit cards only have two or three suits rather than all four for which they can substitute.

Figure 7A:
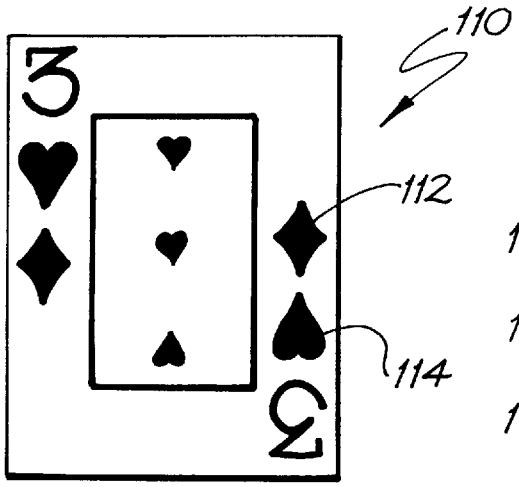
FIGS. 7*a* to 7*c* show variations of a card, in accordance with another embodiment of the invention.
Figure 7B:
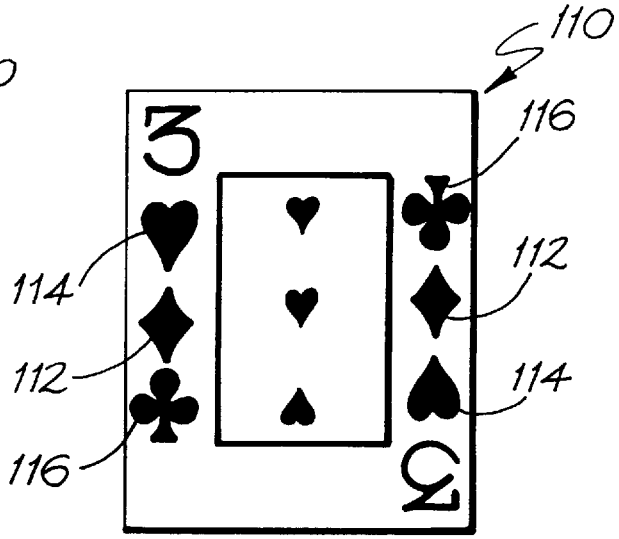
Figure 7C:
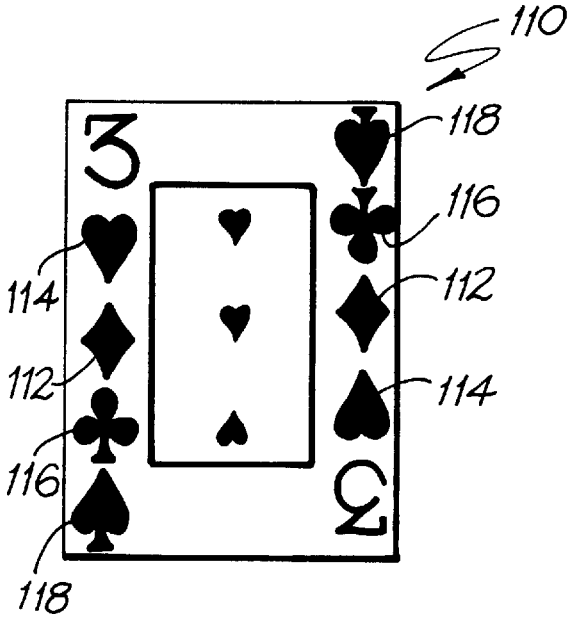

This is shown in greater detail in FIGS. 7*a* to 7*c* of the drawings. The following table is applicable to the use of the cards of the type shown in FIGS. 7*a* to 7*c*.

| HAND | BET 1 | BET 2 | BET 3 | BET 4 |
|---|---|---|---|---|
| Royal Flush-Heart | 1000 | 2000 | 3000 | 10000 |
| Royal Flush | 1000 | 1000 | 1000 | 1600 |
| Straight Flush-Heart | 175 | 350 | 570 | 800 |
| Straight Flush | 175 | 175 | 190 | 200 |
| 4 of a kind | 20 | 20 | 20 | 20 |
| Full House | 7 | 7 | 7 | 7 |
| Flush-Heart | 5 | 10 | 18 | 24 |
| Flush | 5 | 5 | 6 | 6 |
| Straight | 4 | 4 | 4 | 4 |
| 3 of a kind | 3 | 3 | 3 | 3 |

-continued

| HAND | BET 1 | BET 2 | BET 3 | BET 4 |
|---|---|---|---|---|
| 2 pairs | 2 | 2 | 2 | 2 |
| Jacks or better | 1 | 1 | 1 | 1 |

In FIGS. 7*a* to 7*c* a card in accordance with another embodiment of the invention is designated by the reference numeral 110. The card 110 is a multi suit card which, depending on the size of the bet wagered by the player, may have more than one suit thereon. It will be appreciated that, in this embodiment, a 52 card deck (plus one or more joker cards, if desired) is used with multiple suits added to existing cards of the deck When the player bets one credit a standard poker game of "jacks or better" style is applicable. The prizes will be paid for the highest combination from the table as set out above under the heading "Bet 1".

When the player bets two credits, the standard cards representing the suit of hearts are modified as shown in FIG. 7*a* of the drawings. More particularly, the standard cards in the hearts suit in the deck also substitute for diamonds. Accordingly, a diamond symbol 112 appears on the cards 110 in addition to its hearts symbol 114.

Each card in the hearts suit still has its normal functions so that, in the illustrated embodiment in FIG. 7*b* of the drawings, the card is still the 3 of hearts but it also has diamond symbols 112 thereon to indicate that it will substitute for diamond cards.

Because there are now more paying combination over the same total number of possible combination, ie, the total number of cards in the deck remains constant, the paytable is non-linear as set out in the column headed "Bet 2" in the table above. In other words, the prizes when the player bets two credits are not all double what they would be had the player only bet one credit. The prizes for most combinations are the same when the player bets two credits as the player would have received when betting one credit. However, flush combinations are now easier to get because the hearts also substitute for diamonds. The prizes paid for a flush in hearts are double what they would normally be. This is so because the cards are treated as a flush in diamonds and a flush in hearts together.

In FIG. 7*b* of the drawings, it is assumed that the player has bet 3 credits. The hearts suit now, in addition to the diamond symbols 112, includes the clubs suit as represented by symbols 116 on the cards 110 of the hearts suit.

Consequently, the cards 110 will substitute for both diamonds and clubs in a similar manner to that described above. It is to be noted in the "Bet 3" column of the table that the prizes for a straight flush in hearts and a flush in hearts are slightly more than treble the original prize to give the player an extra bonus.

Finally, as shown in FIG. 7*c* of the drawings, when the player bets 4 credits, the card 110 will also substitute for the spades suit. The cards 110 include spade symbols 118.

The prizes for all flush combinations in hearts are more than 4 times the original prize to provide a bonus to the player as shown in the "Bet 4" column in the table below.

Figure 8:
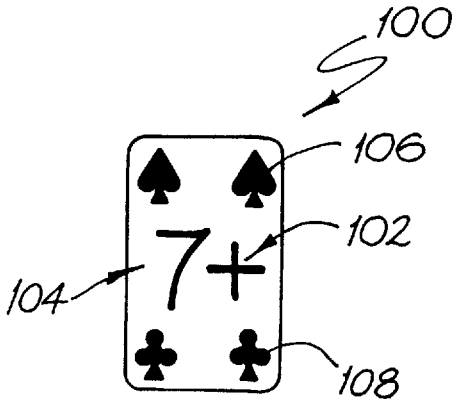
FIG. 8 shows a card, in accordance with yet a further embodiment of the invention.

Referring now to FIG. 8 of the drawings, another embodiment of a multi-function card in the form of a multi-value card 100 is illustrated. The multi-value card includes a symbol 102 on it which results in the card 100 substituting for more than one value. In the example illustrated, the card

100 has a "+" sign 102 carried on it in addition to its face value 104 of "7". This means that the card 100 substitutes for all face values from 7 to a high ace. If, instead, the symbol 102 were a "–" the card 100 would substitute for the face value and all cards below that to a low ace. In other examples of the multi-value card 100, one card may be a "picture" card (not shown) which will substitute for any one of the picture or "royal" card values. Further still, a dual value card (not shown) could be provided such as, for example, a "5/K" card which would then substitute for either a five or a King.

As illustrated in FIG. 8, the multi-value card 100 could also operate as a multi-suit card. In the embodiment illustrated, the card 100 would be applicable for the suit of spades as illustrated at 106 or clubs as illustrated at 108. It will, of course, be appreciated that the multi-value card 100 could have all four suits as is the case with the multi-suit card 50.

Hence, it is an advantage of the invention that a poker game 16 is provided which has a greater variation of prize winning combinations available than would be the case if only a standard deck were used.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A gaming machine having a display means and a game control means arranged to control images displayed on the display means, the game control means being arranged to play a game of poker wherein a hand of cards is randomly selected from at least one deck of cards and displayed on the display means and, if a winning hand results, the machine pays a prize, the game being characterised in that the deck of cards includes at least one multi-function card which substitutes for at least two, but less than all, standard cards of the deck, said at least one multi-function card carrying, in addition to its face value and suit representation, at least one additional function performing symbol.

2. The gaming machine of claim 1 in which said at least one multi-function card acts as a substitute card.

3. The gaming machine of claim 2 in which the additional symbol relates at least one additional suit.

4. The gaming machine as claimed in claim 3 in which the number of suits appearing on said at least one multi-function card is governed by a wager made by a player.

5. The gaming machine of claim 2 which includes a plurality of the multi-function cards, the multi-function cards constituting a separate suit.

6. The gaming machine of claim 5 in which the deck of cards includes a further suit of the muiti-function cards.

7. The gaming machine of claim 1 in which the additional function performing symbol is a multi-value symbol so that, when it appears on a card, the card represents, not only its own face value, but also at least one other, predetermined face value.

8. A gaming machine having a display means and a game control means arranged to control images displayed on the display means, the game control means being arranged to play a game of poker wherein a hand of cards is randomly selected from at least one deck of cards and displayed on the display means and, if a winning hand results, the machine pays a prize, the game being characterised in that the deck of cards includes at least one suit of cards which substitutes for at least one other suit of cards of the deck, the number of suits for which the at least one suit of cards substitutes being dependent on the wager made by the player.

* * * * *